US005970575A

United States Patent [19]

Lee

[11] Patent Number: 5,970,575

[45] Date of Patent: Oct. 26, 1999

[54] DUST-COLLECTING UNIT FOR A COMBINATION-TYPE VACUUM CLEANER

[75] Inventor: Nam-Ho Lee, Seoul, Rep. of Korea

[73] Assignee: Daewoo Electronics Co. Ltd., Seoul, Rep. of Korea

[21] Appl. No.: 08/720,502

[22] Filed: Sep. 30, 1996

[30] Foreign Application Priority Data

Sep. 29, 1995 [KR] Rep. of Korea ..... 95-32675

[51] Int. Cl.[6] ..... A47L 5/28

[52] U.S. Cl. ..... 15/328; 15/350; 15/352

[58] Field of Search ..... 15/350, 351, 352, 15/335, 328, 334, 337

[56] References Cited

U.S. PATENT DOCUMENTS 4,129,920 12/1978 Evans et al. ..... 15/337

4,393,536 7/1983 Tapp ..... 15/355 X 5,054,157 10/1991 Werner et al. ..... 15/328

5,715,566 2/1998 Weaver et al. ..... 15/328 X

*Primary Examiner*—Chris K. Moore

*Attorney, Agent, or Firm*—Nixon & Vanderhye P.C.

[57] ABSTRACT

A dust-collecting unit for a combination-type vacuum cleaner having a dust-collecting body and a cleaner body and alternatively operable as an upright-type vacuum cleaner or as a canister-type vacuum cleaner is disclosed. The dust-collecting unit includes an air-guiding part having first, second and third air-guiding pipes, and a door part. The door part accommodates a portion of the air-guiding part, closes and opens the dust bag receptacle part, and engages or disengages the air-guiding part with or from the dust bag receptacle part.

8 Claims, 7 Drawing Sheets

DUST-COLLECTING UNIT FOR A COMBINATION-TYPE VACUUM CLEANER

BACKGROUND OF THE INVENTION

1. Field of the Invention

The present invention relates to a vacuum cleaner, more particularly to a dust-collecting unit for a combination-type vacuum cleaner alternatively operable as a canister-type vacuum cleaner or as an upright-type vacuum cleaner.

2. Prior Art

Generally, a vacuum cleaner is classified as a canister-type vacuum cleaner, an upright-type vacuum cleaner, or a combination-type vacuum cleaner according to its structure.

The canister-type vacuum cleaner refers to a vacuum cleaner having a cleaner brush head and a cleaner body which are separated from each other. The cleaner brush head is connected with one end of a suction pipe part having a plurality of suction pipes, which are substantially hollow pipes. The other end of the suction pipe part is engaged with a cleaner body through a flexible hose. In general, the cleaner body is provided with a pair of wheels. The pair of wheels facilitate the movements of the cleaner body. The cleaner brush head has an intake hole for suctioning dust together with external air, etc. The dust is collected to remain in the cleaner body by filtering the suctioned air containing dust, etc. The filtered air is exhausted out of the cleaner body.

The upright-type vacuum cleaner refers to a vacuum cleaner having a cleaner brush head and a cleaner body which are connected with each other in one body. The upright-type vacuum cleaner has the same function as the canister-type vacuum cleaner has.

The combination-type vacuum cleaner refers to a vacuum cleaner having a dust collector including a cleaner brush head, and a cleaner body, both of which are detachably connected with each other. A connector is provided on the dust collector between the cleaner brush head and the cleaner body so as to connect/disconnect the dust collector with/from the cleaner body. Therefore, a user enables the combination-type vacuum cleaner to be alternatively operated as a canister-type vacuum cleaner or as an upright-type vacuum cleaner.

FIG. 1 is a schematic side view for showing a general canister-type vacuum cleaner, and FIG. 2 is a schematic side view for showing a general upright-type vacuum cleaner.

As shown in FIG. 1 and FIG. 2, the canister-type vacuum cleaner or the upright-type vacuum cleaner has a cleaner body 12 or 22 comprising a dust-collecting chamber and a cleaner-driving chamber (both not shown). Further, a pair of wheels 11 or 21 is provided with cleaner body 12 or 22. The pair of wheels 11 or 21 facilitates the movements of cleaner body 12 or 22.

Cleaner body 12 of the canister-type vacuum cleaner is connected with one end of the suction pipe part 16. Suction pipe part 16 has a plurality of suction pipes 16*a*, 16*b*, and 16*c*. The other end of the suction pipe part 16 is connected with a cleaner brush head 13 which suctions air together with dust, etc.

Cleaner body 22 of the upright-type vacuum cleaner is integrally connected with a cleaner brush head 23 through a flexible hose 26. Cleaner brush head 23 suctions air together with dust, etc. Reference numeral 24 denotes a suction strength control switch, and reference numeral 25 denotes a handle part.

The canister-type vacuum cleaner enables every nook and cranny to be cleaned. Further, in the canister-type vacuum cleaner, the replacement of parts for the cleaner brush head, etc., can be accomplished with ease, and the burden of some weight on the user is relatively small. However, the canister-type vacuum cleaner requires a relatively big space for being stored at home as well as takes much time for assembling or disassembling the flexible hose, suction pipe part 16, etc.

In comparison, the upright-type vacuum cleaner has advantages of its facilitation in cleaning a spacious place and of its requirement of a small space for storage at home. The upright-type vacuum cleaner can be immediately used without any further manipulation such as assembling or disassembling the flexible hose or suction pipe part as mentioned above. However, the user is inevitably burdened by the weight of the cleaner. Further, since the upright-type vacuum cleaner does not allow every nook and cranny to be cleaned because of its size, cleaning efficiency is greatly decreased.

FIG. 3 is a schematic view for showing a conventional combination-type vacuum cleaner when used as an upright-type vacuum cleaner, and FIG. 4 is a schematic view for showing a conventional combination-type vacuum cleaner when used as a canister-type vacuum cleaner. As shown in FIG. 3 and FIG. 4, the combination-type vacuum cleaner comprises a dust-collecting unit 31 and a cleaner body unit 30. Dust-collecting unit 31 suctions air together with dust, collects the dust by filtering the air, and exhausts the filtered air. Cleaner body unit 30 is provided with a pair of wheels 32 for its easy movement and with a vacuum pump for its air suction. Further, dust-collecting unit 31 has an engagement part for cleaner body unit 31. Dust-collecting unit 31 is engaged with or disengaged from cleaner body unit 30 by means of the engagement part.

With the structure mentioned above, the combination-type vacuum cleaner can be converted or changed to be alternatively operable as a canister-type vacuum cleaner or as an upright-type vacuum cleaner in accordance with a user's necessity. Accordingly, the combination-type vacuum cleaner can enhance the cleaning efficiency.

SUMMARY OF THE INVENTION

It is an object of the present invention to provide a dust-collecting unit having a dust-collecting structure suitable for a combination-type vacuum cleaner.

In order to achieve the above object, the dust-collecting unit for a combination-type vacuum cleaner has a cleaner brush head and a dust-collecting body. The dust-collecting body comprises a main body, an air inlet part, an air-guiding part, a dust bag receptacle part, a door part, an engagement part for a cleaner body unit, and an air outlet part. The cleaner brush head has a slit for suctioning air together with dust from outside. The dust-collecting body receives the air suctioned from the slit, filters the air, and exhausts the filtered air. The air inlet part is communicated with the slit of the cleaner brush head so as to receive the air containing dust from the slit. The air-guiding part guides the dust-containing air which flows in from the air inlet part. The dust bag receptacle part accommodates a dust bag. The door part accommodates a portion of the air-guiding part, and closes or opens the dust bag receptacle part so as to be engaged with or disengaged from the air-guiding part. The engagement part for the cleaner body unit is engaged with the cleaner body unit. The air outlet part is communicated with the dust bag receptacle part so as to exhaust the filtered air into a flexible hose which is connected between the dust-collecting body and a cleaner body unit. The air-guiding part comprises a first air-guiding part, a second air-guiding part, and a third air-guiding part. One end of the first air-guiding part is connected with the air inlet part, bent twice to form a step thereon, and guides the dust-containing air. One end of the second air-guiding part is connected with the other end of the first air-guiding part, has flexibility, and guides the air flowing in from the first air-guiding part. One end of the third air-guiding part is connected with the other end of the second air-guiding part, is bent once, and guides the air flowing in from the second air-guiding part. The dust bag receptacle part comprises a rib part, a dust bag holding part, and a pair of dust bag fixing parts. The rib part is formed with a plurality of ribs longitudinally protruded on the bottom of the dust bag receptacle part so as to prevent a dust bag from being closely attached on the bottom when the dust bag is inflated with the air flowing thereinto. The dust bag holding part enables the dust bag to be fixedly inserted. The dust bag holding part is rotated inside and outside the dust bag receptacle part. The pair of dust bag fixing parts is opposedly and upwardly protruded from the bottom of the dust bag receptacle part in order for the dust bag to be fixedly inserted to prevent the dust bag from moving about. The door part comprises a door body part, and a first cover for the door body part. The door body part is connected with a portion of the air-guiding part, and hinge-connected with the air-collecting body to rotatably close and open the receptacle part. The door body part engages or disengages the dust bag receptacle part with or from the air-guiding part. The first cover for the door body part is engaged with the door body part to cover a portion of the air-guiding part to be supported thereby, and has a knob to facilitate the closing and opening of the door part.

The door part is closed when the vacuum cleaner is operating for cleaning. Therefore, the closed door part seals the dust bag receptacle part of the air-collecting body. The dust-containing air flows into the dust-collecting body through the slit of the cleaner brush head. The air flowing into the dust-collecting body passes through the air-guiding part. The air from the air-guiding part flows into the dust bag. The dust bag has porous sides. The filtered air (dust-free air) flows out of the dust bag through the porous sides, so the dust in the air remains in the dust bag. The filtered air is exhausted through the air outlet part of the dust-collecting body.

As mentioned above, the dust-collecting unit according to the present invention has a door part and an air-guiding structure suitable for the combination-type vacuum cleaner.

BRIEF DESCRIPTION OF THE DRAWINGS

The present invention may be better understood and its objects and advantages will be more apparent to those skilled in the art by reference to the accompanying drawings, in which.

DETAILED DESCRIPTION OF THE INVENTION

An embodiment according to the present invention will be hereinafter described in detail with reference to the accompanying drawings.

Figure 2:
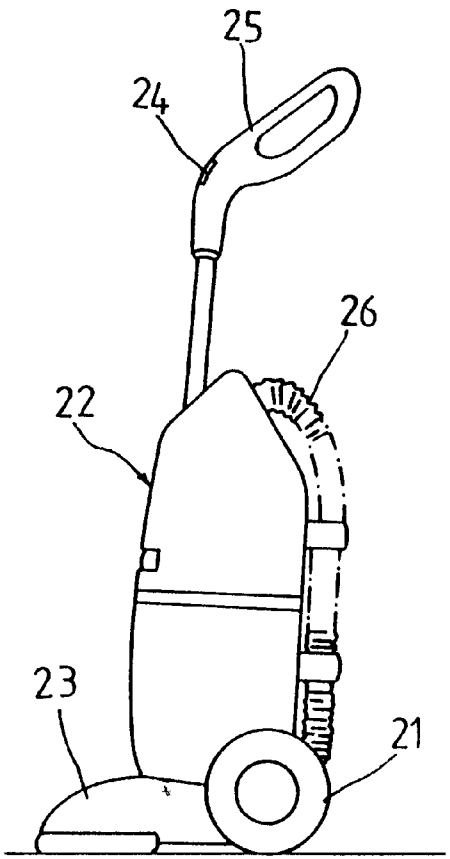
FIG.2 PRIOR ART
FIG. 2 is a view for schematically showing a general upright-type vacuum cleaner.
Figure 1:
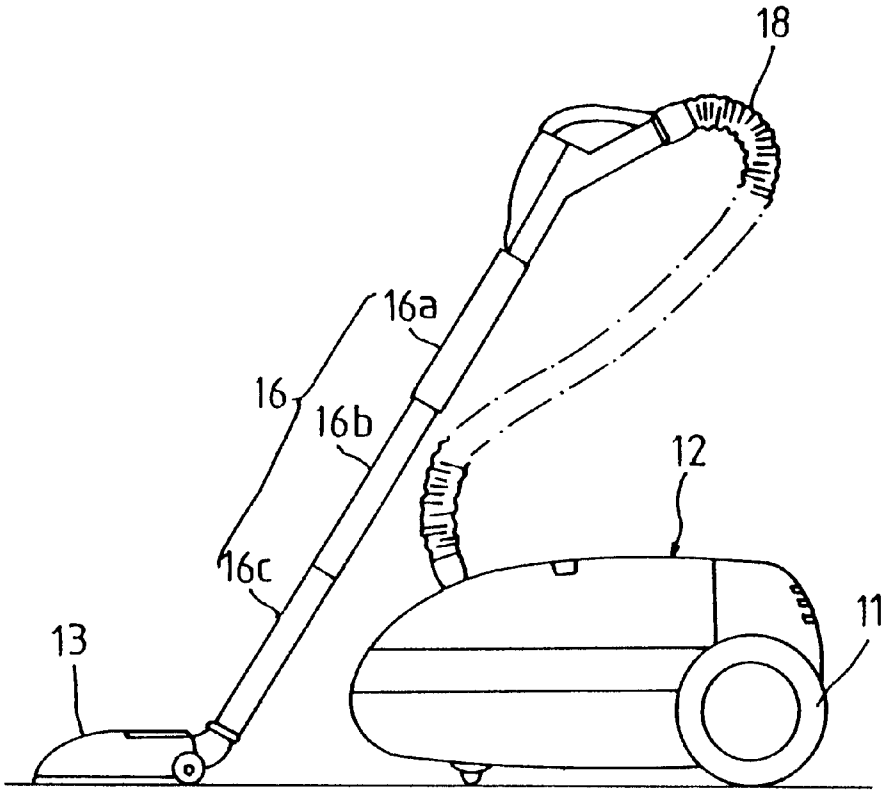
FIG.1 PRIOR ART
FIG. 1 is a view for schematically showing a general canister-type vacuum cleaner.
Figure 4:
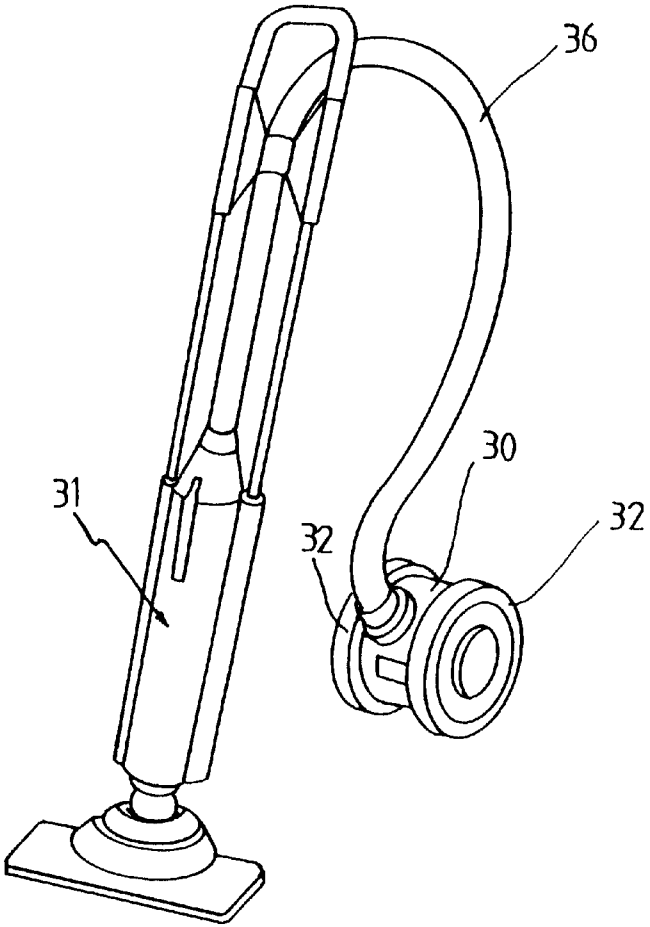
FIG. 4 PRIOR ART
FIG. 4 is a view for schematically showing a general combination-type vacuum cleaner in use as a canister-type vacuum cleaner.
Figure 3:
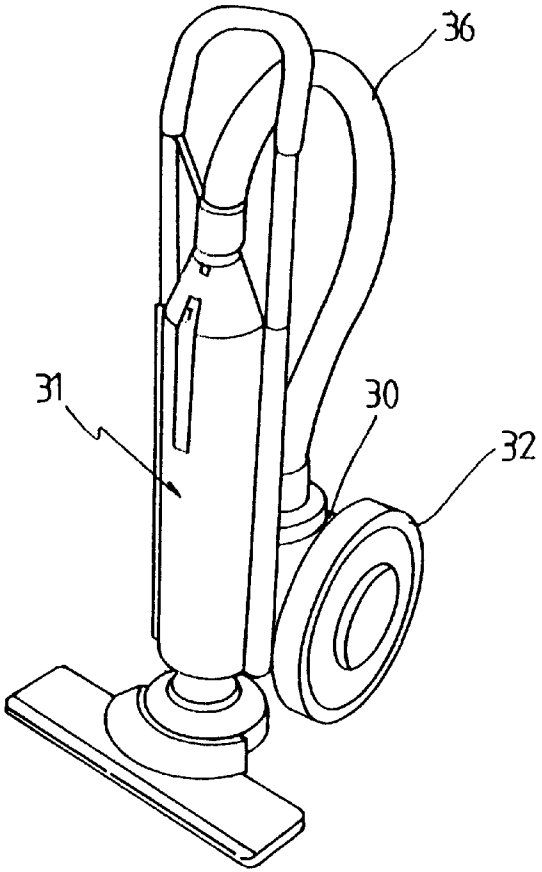
FIG. 3 PRIOR ART
FIG. 3 is a view for schematically showing a general combination-type vacuum cleaner in use as an upright-type vacuum cleaner.
Figure 5:
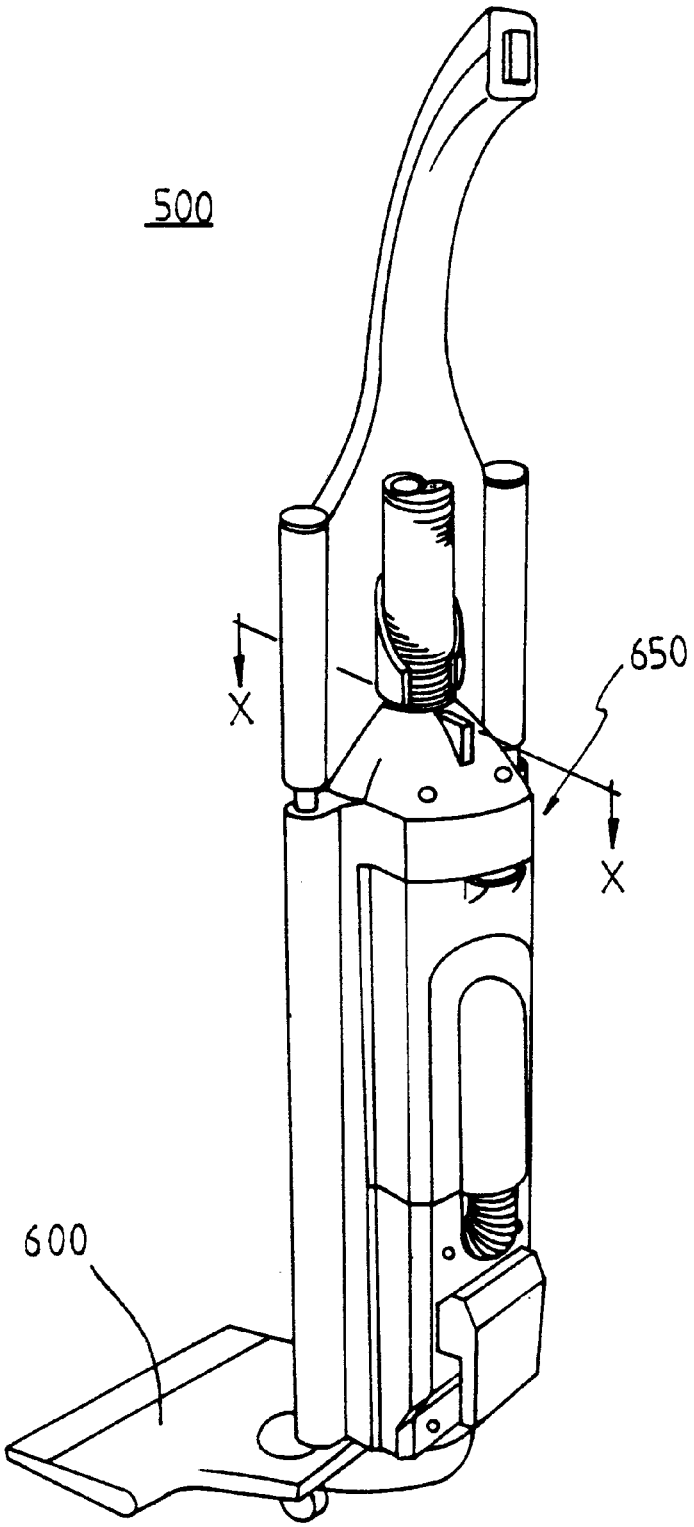
FIG. 5 is a view for showing a dust-collecting unit for the combination-type vacuum cleaner of FIG. 3 and FIG. 4 according to an embodiment of the present invention.
Figure 10:
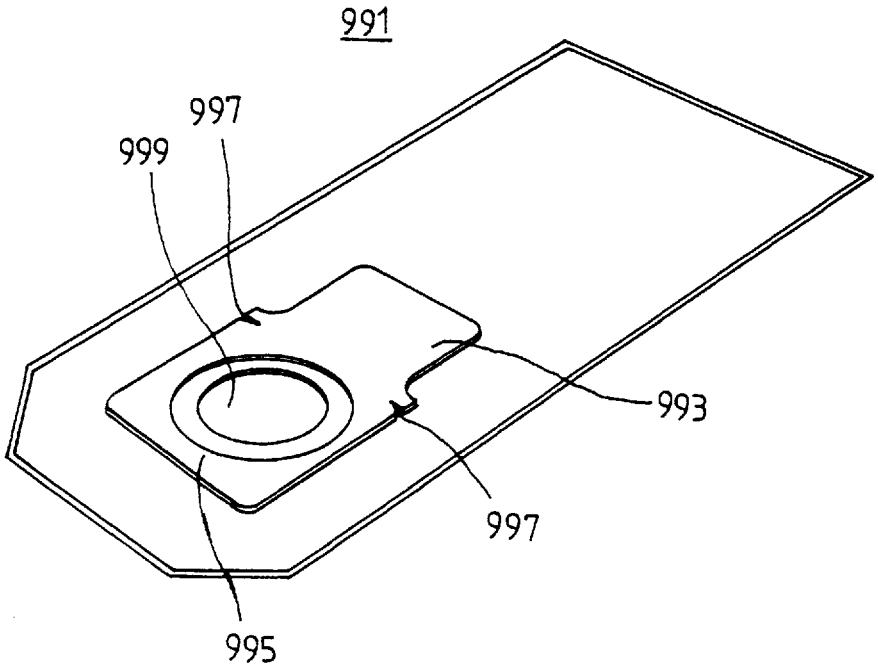
FIG. 10 is a view for schematically showing a general dust bag.
Figure 9:
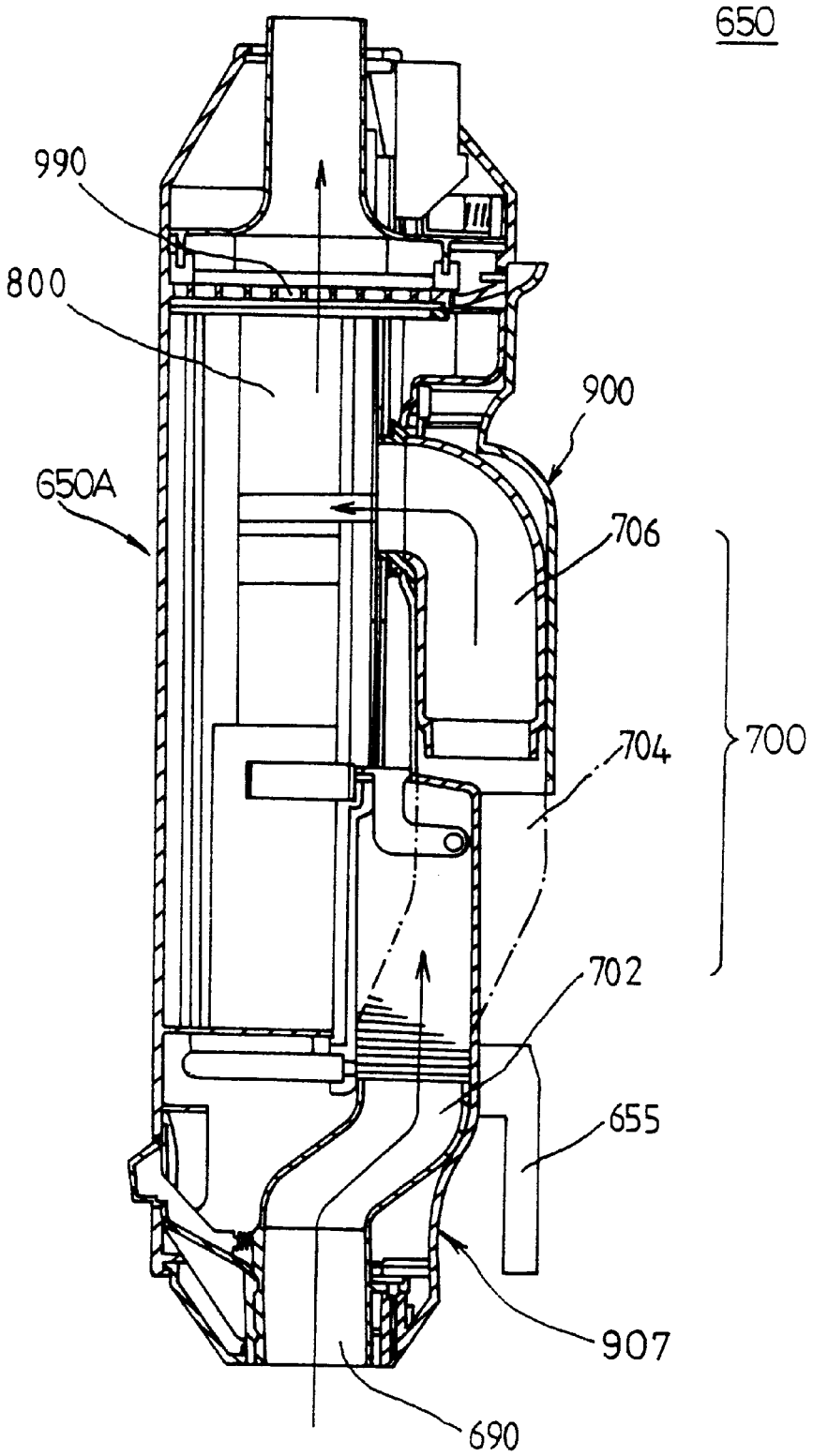
FIG. 9 is a view for showing the dust-collecting unit of FIG. 5 cross-sectioned in the X—X direction.

FIG. 5 is a view for showing a dust-collecting unit for the combination-type vacuum cleaner of FIG. 3 and FIG. 4 according to an embodiment of the present invention, FIG. 9 is a view for showing the dust-collecting unit of FIG. 5 cross-sectioned in the X—X direction, and FIG. 10 is a view for schematically showing a general dust bag. As shown in FIGS. 5, 9 and 10, a dust-collecting unit 500 comprises a cleaner brush head 600 and a dust-collecting body 650. Cleaner brush head 600 has a slit (not shown). The slit is a passageway for suctioning air from the outside. The air suctioned through the slit flows into dust-collecting body 650. Dust-collecting body 650 filters the dust-containing air, collects dust, and exhausts dust-free air or filtered air.

Dust-collecting body 650 comprises a main body 650A, an air inlet part 690 as shown in FIG. 9, an air-guiding part 700, a dust bag receptacle part 800, a door part 900, an engagement part 655, and an air outlet part 990.

Air inlet part 690 is mounted inside a lower end portion of main body 650A and is communicated with the slit of the cleaner brush head 600 in order for the air from the slit to flow in. The air flowing through air inlet part 690 flows in air-guiding part 700. Air-guiding part 700 provides an air passageway for guiding the air into dust bag receptacle part 800 from the slit. Air-guiding part 700 is provided with a plurality of air-guiding pipes. In the embodiment according to the present invention, the plurality of air-guiding pipes comprise a first air-guiding pipe 702, a second air-guiding pipe 704, and a third air-guiding pipe 706. First air-guiding pipe 702 is a pipe which is twice bent to suitably connect air inlet part 690 with second air-guiding pipe 704 to conform with the shape of main body 650A. That is, one end portion of first air-guiding pipe 702 is connected to air inlet part 690, and the other end portion thereof is connected to one end portion of second air-guiding pipe 704. Second air-guiding pipe 704 may be a flexible hose. The other end portion of second air-guiding pipe 704 is connected to one end portion of third air-guiding pipe 706. Third air-guiding pipe 706 is a pipe which is once bent to suitably connect second air-guiding pipe 704 with dust bag receptacle part 800. The other end portion of third air-guiding pipe 706 is connected to dust bag receptacle part 800. In the embodiment according to the present invention, third air-guiding pipe 706 is bent at nearly a 90 degree angle Engagement part 655 is a part for engaging dust-collecting body 650 with cleaner body unit 30 as shown in FIGS. 3 and 4.

Figures 6, 6A:
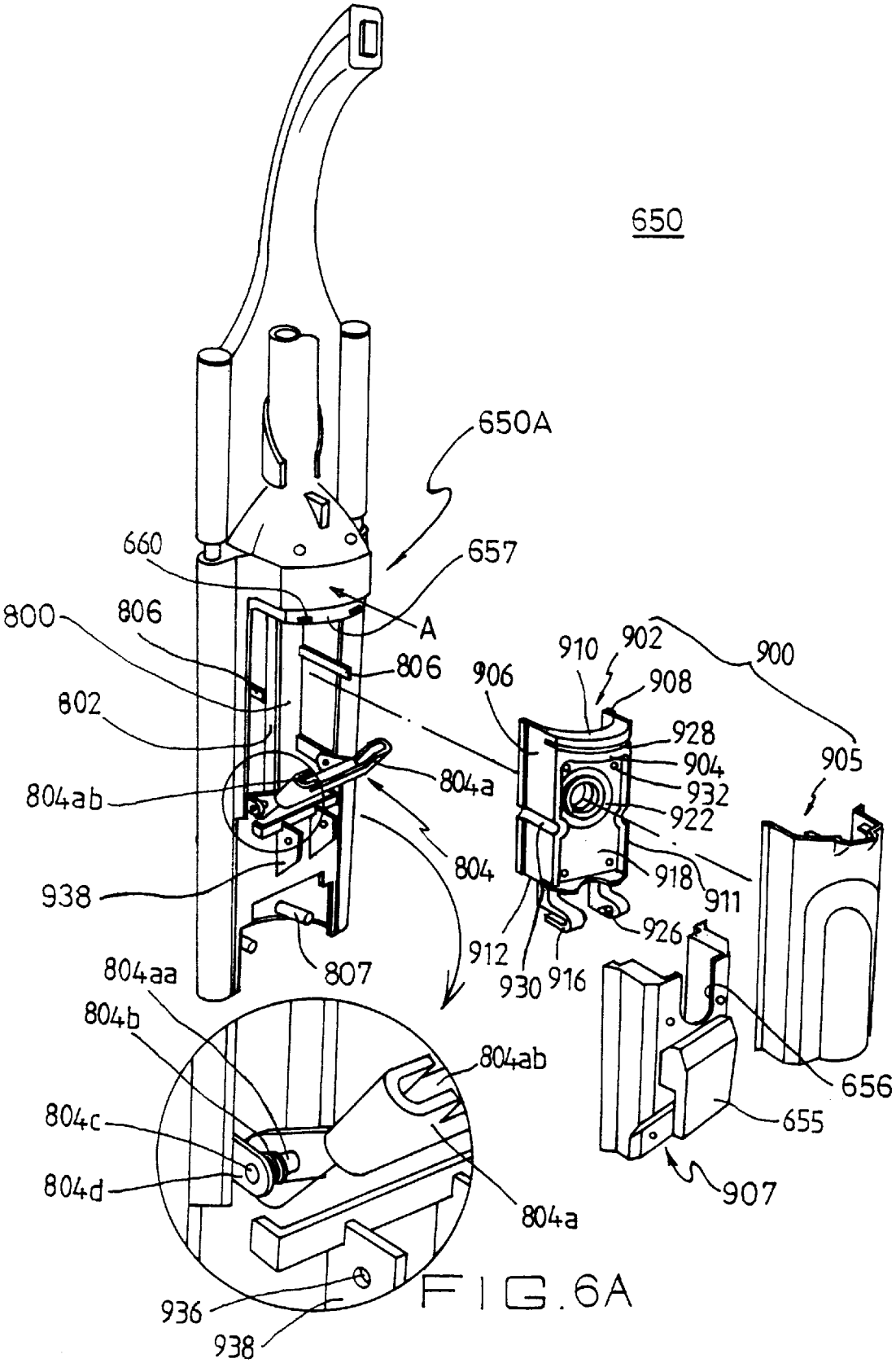
FIG. 6 is a view for showing a door part and a dust-collecting body of FIG. 5 in an exploded state.
Figure 7:
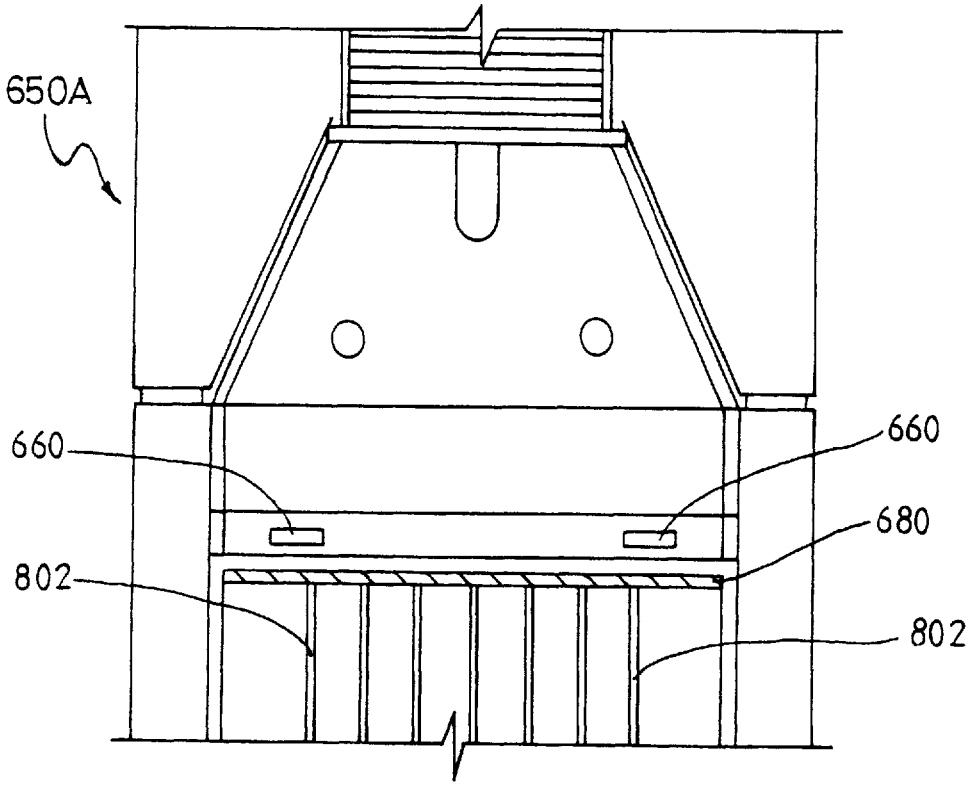
FIG. 7 is a view for showing a portion of the dust-collecting body of FIG. 6 when viewed in an A direction of FIG. 6.

FIG. 6 is a view for showing a door part and a dust-collecting body of FIG. 5 in an exploded state, FIG. 6A is a view for showing a dust bag holding part of FIG. 6, and FIG. 7 is a view for showing a portion of the dust-collecting body of FIG. 6 in detail. As shown in FIGS. 6, 6A, and 7, main body 650A comprises a connecting portion 652 having a pair of engagement grooves 660 for door part 900, a pair of first protrusions 938 having a pair of insertion holes 936, and a sealing member 680. The upper portion of door part 900 is engaged with main body 650A by means of the pair of engagement grooves 660 to thereby prevent door part 900 from moving about. The pair of engagement grooves 660 is a pair of grooves formed at a certain distance therebetween over dust bag receptacle part 800. That is, the pair of engagement grooves 660 is formed over sealing member 680. The pair of first protrusions 938 protrudes from main body 650A and below dust bag receptacle part 800. Each of the pair of first protrusions 938 has an insertion hole 936. The lower portion of door part 900 is rotatably engaged with the pair of insertion holes 936 in order for door part 900 to rotatably open and close dust bag receptacle part 800. Dust bag receptacle part 800 has space formed approximately the middle of main body 650A to accommodate dust bag 991. Dust bag receptacle part 800 comprises a rib portion 802, a dust bag holding part 804, and a pair of dust bag fixing parts 806. Rib portion 802 has a plurality of ribs. Each one of the plurality of ribs is a protrusion longitudinally formed on the bottom of dust bag receptacle part 800. The plurality of ribs is spaced apart at a certain distance therebetween. When dust bag 991 is inflated with the suctioned air, rib portion 802 prevents dust bag 991 from being in close contact with the bottom of dust bag receptacle part 800. Accordingly, rib portion 802 enables dust bag 991 to fully filter the suctioned air therein.

Dust bag holding part 804 accommodates a dust bag 991, and is rotated inside and outside dust bag receptacle part 800. Dust bag holding part 804 comprises a dust bag inserting body 804*a*, a spring 804*b*, and a pair of second protrusions 804*d* each having a second insertion hole 804*c*. Dust bag inserting body 804*a* is rotatably engaged with the pair of second insertion holes 804*c*. Dust bag receptacle part 800 has room for removably accommodating dust bag 991. Dust bag inserting body 804*a* has third protrusions 804*aa* each formed on opposite lower sides of dust bag inserting body 804*a*. The pair of second protrusions 804*d* is oppositely formed on main body A and on a lower portion of dust bag receptacle part 800. The pair of third protrusions 804*aa* is correspondingly inserted into the pair of second insertion holes 804*c*. Therefore, the pair of third protrusions 804*aa* becomes an axis about which dust bag inserting body 804*a* is rotated. The top portion of dust bag inserting body 804*a* has a dust bag inserting groove 804*ab*. Dust bag 991 is fixedly inserted in dust bag inserting groove 804*ab*. Spring 804*b* is mounted on one of the pair of third protrusions 804*aa*. One end of spring 804*b* supports the front side of dust bag inserting body 804*a*. The front side is the side toward dust bag receptacle part 800. Spring 804*b* gives a rotating force to dust bag inserting body 804*a* so that dust bag inserting body 804*a* is rotated outside dust bag receptacle part 800. Accordingly, when door part 900 which will be described in detail later is opened, dust bag inserting body 804*a* is rotated by spring 804*b* toward dust bag receptacle part 800.

The pair of dust bag fixing parts 806 is a pair of protrusions oppositely formed on dust bag receptacle part 800. The pair of dust bag fixing parts 806 fixedly support the dust bag 991 at opposite sides of dust bag 991 inserted into dust bag receptacle part 800. The pair of dust bag fixing parts 806 prevents dust bag 991 from freely moving about.

Sealing member 680 is mounted on the upper wall of dust bag receptacle part 800. Sealing member 680 prevents the suctioned air in dust bag receptacle part 800 from flowing out of dust bag receptacle part 800.

Figure 8:
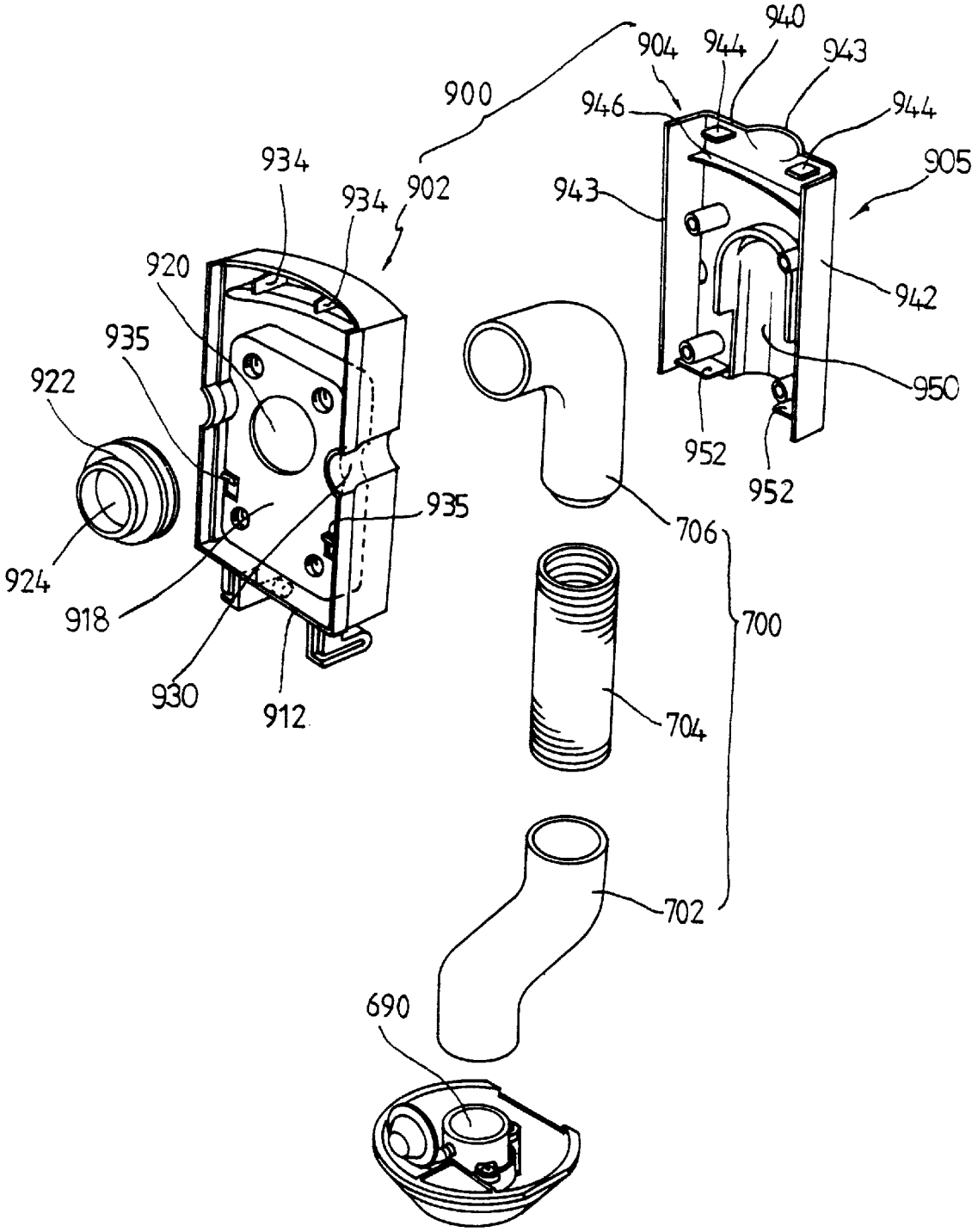
FIG. 8 is an exploded view for showing a door part of FIG. 6 in detail.

FIG. 8 is an exploded view for showing a door part of FIG. 6. As shown in FIGS. 6 and 8, door part 900 comprises a door body part 902, a first cover 905 for door body part 902, and a second cover 907 having engagement part 655. Door part 900 rotatably opens or closes dust bag receptacle part 800, so as to engage or disengage air-guiding part 700 with or from the upper portion of dust bag receptacle part 800. The flexible hose is extended below the first cover 905 to provide flexibility when the door part 900 opens and closes. Door body part 902 comprises a first base plate 904, a first side wall 906, a second side wall 908 formed on opposite sides of first base plate 904, a third side wall 910 formed on the top portion of first base plate 904, a fourth side wall 912 formed on the bottom of first base plate 904, a fifth side wall 911, and a pair of hinge portions 916. The front side of first base plate 904 has a rectangular recessed portion 918 provided with a circular hole 920. The front side is a side toward first cover 905. A sealing rubber 922 is inserted into circular hole 920. One side of sealing rubber 922 has a circular opening 924 fixedly accommodating the other end portion of third air-guiding pipe 706, the other side of sealing rubber 922 has a circular protrusion to be inserted into the air inlet hole 999, in FIG. 10, of dust bag 991. First side wall to fifth side wall 906, 908, 910, 912, and 911 are protruded toward dust bag receptable part 800. The pair of hinge portions 916 is protruded out from the bottom side of fourth side wall 912 to be once bent for rotatable connection with insertion holes 936 in FIG. 6. One end portion of each of the pair of hinge portions 916 has a fourth protrusion 926, so that the pair of protrusions 926 is oppositely protruded from each other. The front side of first base plate 904 has a laterally formed groove 928 on the upper portion thereof. A traverse groove 930 is formed between first side wall 906 and fourth side wall 912 and between second side wall 908 and fifth side wall 911, respectively. The pair of dust bag fixing parts 806 is engaged and disengaged with and from the pair of traverse grooves 930 when door body part 902 closes and opens dust bag receptacle part 800. Each of the four corners of rectangular recessed portion 918 has an engaging hole 932. The rear side of first base plate 904 is provided with a pair of support protrusions 934 and a pair of limit protrusions 935. The pair of support protrusions 934 supports sealing member 680 mounted on the upper wall of dust bag receptacle part 800. The pair of support protrusions 934 tightly seal dust bag receptacle part 800, thereby preventing the air from flowing out of dust bag receptacle part 800. The tight sealing by the pair of support protrusions 934 is necessary because the pressure of the suctioned air may cause a gap between sealing member 680 and door body part 902. The pair of fourth protrusions 926 is inserted into the pair of insertion holes 936. The insertion of the pair of fourth protrusions 926 into the pair of insertion holes 936 enables door part 900 to rotatably open and close dust bag receptacle part 800.

If door part 900 is closed without an insertion of dust bag 991 into dust bag inserting body 804*a*, the pair of limit protrusions 935 limits the rotation of door part 900 toward dust bag receptacle part 800, to thereby prevent door part 900 from being closed without an insertion of dust bag 991. When closing door part 900 with an insertion of dust bag 991 into dust bag inserting body 804*a*, dust bag inserting body 804*a* is, firstly, pushed inside dust bag receptacle part 800 to eliminate the limit of the rotation of door part 900, so that door part 900 can be closed because it is fully rotated toward dust bag receptacle part 800. First cover 905 comprises a second base plate 940, a sixth side wall 942 and a seventh side wall 943 which are formed on opposite sides of second base plate 940, respectively. The front side of second base plate 940 has a knob 943 on the top portion thereof. Knob 943 enables door part 900 to facilitate the opening and closing of dust bag receptacle part 800. The rear side of second base plate 940 has a pair of first engagement protrusions 944, a first insertion protrusion 946, four engagement grooves 948, an air-guiding receptacle groove 950, and a pair of second insertion protrusions 952. The pair of first engagement protrusions 944 is forwardly protruded from the upper portion of the rear side thereof. When door part 900 is closed, the pair of first engagement protrusions 944 is engaged with the pair of engagement grooves 660 of main body 650A. Accordingly, the pair of first engagement protrusions 944 is formed to correspond to the pair of engagement grooves 660. The engagement of the pair of first engagement protrusions 944 with the pair of engagement grooves 660 firmly fixes door part 900 to main body 650A, to thereby prevent door part 900 from moving about. First insertion protrusion 946 is formed in a lateral direction immediately below the pair of first engagement protrusions 944. When door part 900 is closed, first insertion protrusion 946 is inserted in groove 928. First insertion protrusion 946 fixes first cover 905 to door body part 902 to thereby prevent first cover 905 from moving about on door body part 902. Four engagement grooves 948 are engaged with four engaging holes 932 of rectangular recessed portion 918, respectively. Screw may be used for this engagement. Air-guiding receptacle groove 950 has nearly a semicircular shaped groove longitudinally formed for supporting third air-guiding pipe 706. The length of third air-guiding pipe 706 is long enough to nearly reach the pair of second insertion protrusions 952 from circular hole 920. The pair of second insertion protrusions 952 is formed immediately below four engagement grooves 948. The pair of second insertion protrusions 952 is fitted to the bottom side of door body part 902 in order for first cover 905 to be fixed to door body part 902, to thereby prevent first cover 905 from moving about on door body part 902. The upper portion of second air-guiding pipe 704 is accommodated with the lower portion of third air-guiding pipe 706, thereby providing flexibility for door part 900 to be closed and opened since second air-guiding pipe 704 may be a flexible hose as mentioned above. The upper portion of dust bag receptacle part 800 is communicated with one end of air outlet part (not shown) formed in main body 650A in order for the suctioned air to flow out of dust bag receptacle part 800. The other end of the air outlet part is connected with a flexible hose 36 as shown in FIG. 4 in order for the filtered air to flow into cleaner body unit 30. The connection between dust bag receptacle part 800 and the air outlet part may be found in a general vacuum cleaner.

Referring to FIGS. 6 and 8, second cover 907 has engagement part 655 as mentioned above. Second cover 907 covers first air-guiding pipe 702 and second air-guiding pipe 704. Second cover 907 is mounted between first cover 905 and cleaner brush head 600. Engagement part 655 is connected/disconnected with/from cleaner body unit 30 as in FIGS. 3 and 4. This connection/disconnection of engagement part 655 with/from cleaner body unit 30 may be seen in a general combination-type vacuum cleaner. Second cover 907 has a groove 656 formed on the upper portion thereof for accommodating a portion of the flexible hose, which is second air-guiding pipe 704, for flexibility when the door part opens and closes. A pair of second cover protrusions 807 is provided with main body 650A to respectively connect a pair of receiving grooves (not shown) of second cover 907. The pair of receiving grooves is formed on the inner side of second cover 907 to fit with the pair of second cover protrusions 807 while engagement part 655 is mounted on the outer side of second cover 907 to be engaged/disengaged with/from cleaner body unit 30 as in FIGS. 3 and 4.

Operations of the embodiment according to the present invention will be in detail described hereinafter.

First, the cleaning operations will be described. When cleaning, door part 900 is closed. Therefore, closed door part 900 seals dust bag receptacle part 800 of main body 650A. Air is suctioned together with dust into dust-collecting body 650 through the slit formed in cleaner brush head 600. The air suctioned in dust-collecting body 650 passes through first, second and third air-guiding pipes 702, 704 and 706 of air-guiding part 700. The air from third air-guiding pipe 706 flows in dust bag 991 mounted in dust bag receptacle part 800. The air flows out of dust bag 991 through the porous side of dust bag 991, that is, the air is filtered by the porous side of dust bag 991. By the filtration of the air, dust-free air passes out through the porous side, so dust in the air remains in dust bag 991. Dust-free air flows into flexible hose 36 of FIG. 4 through the air outlet part of dust-collecting body 650.

Next, insertion and removal of dust bag 991 will be described.

FIG. 10 is a view for schematically showing a general dust bag. Dust bag 991 is provided with a rigid paper 993 having an air inlet hole 999. In order to accommodate dust bag 991 in dust bag receptacle part 800, firstly, one end portion 995 of rigid paper 993 is inserted into dust bag inserting groove 804*ab*. Reference numeral 997 denotes a pair of dust bag grooves. After the insertion of dust bag 991, the pair of dust bag grooves 997 is inserted into the pair of dust bag fixing parts 806 to thereby fix dust bag 991. After fixing dust bag 991, door part 900 is closed to seal dust bag receptacle part 800.

The removal of dust bag 991 is performed in reverse procedures of the insertion of dust bag 991.

As mentioned above, the dust-collecting unit according to an embodiment of the present invention is provided with a door part and an air-guiding structure suitable for a combination-type vacuum cleaner.

It is understood that various other modifications will be apparent to and can be readily made by those skilled in the art without departing from the scope and spirit of this invention. Accordingly, it is not intended that the scope of the claims appended thereto be limited to the description as set forth herein, but rather that the claims be constructed as encompassing all the features of the patentable novelty that reside in the present invention, including all the features that would be treated as equivalents thereof by those skilled in the art to which this pertains.

I claim:

1. A dust-collecting unit for a combination-type vacuum cleaner having a dust-collecting body and a cleaner body unit and alternatively operable as an upright-type vacuum cleaner or as a canister-type vacuum cleaner by engaging or disengaging the dust-collecting body with or from the cleaner body unit providing an air suction force, comprising:

a cleaner brush head having a suction slit for suctioning air together with dust from outside;

a dust-collecting body for receiving the air suctioned from the suction slit, filtering the received air to collect dust therein, and exhausting the filtered air, which is dust-free air, the dust-collecting body having;

a main body having an air outlet part in order for the filtered air to be exhausted to the cleaner body unit;

an air inlet part communicated with the suction slit of the cleaner brush head, and for receiving the suctioned air;

an air-guiding part communicated with the air inlet part, and for providing a passageway to guide the received air, wherein a portion of the air-guiding part is a flexible hose to provide flexibility to the air-guiding part;

a dust bag receptacle part formed in the main body, and for accommodating a dust bag, wherein the air outlet part communicates with the dust bag receptacle part;

a door part having a first cover and a door body part with a circular hole and accommodating a portion or the air-guiding part with or from the dust bag receptacle part, wherein the flexible hose is extended below the first cover to provide flexibility when the door part opens and closes, and the one end of the portion of the air-guiding part is engaged with the circular hole for the suctioned air to flow in the dust bag receptacle part when the door part closes;

a second cover having an engagement/disengagement part for engaging and disengaging the dust-collecting body with and from the cleaner body unit, and having a groove formed on an upper portion of the second cover for accommodating a portion of the flexible hose for flexibility when the door part opens and closes the second cover covering the portion of the air-guiding part between the door part and air inlet part; and a dust bag holding part mounted on the main body to be rotated inside and outside the dust bag receptacle part, the dust bag holding part accommodating the dust bag, wherein the dust bag holding part is rotated in and out as the door part closes and opens the dust bag receptacle part.

2. The dust-collecting unit for a combination-type vacuum cleaner as claimed in claim 1, wherein the air-guiding part includes:

a first air-guiding part connected with the air inlet part, and for providing a first portion of the passageway to guide the dust-containing air suctioned from the air inlet part, one end portion of the first air-guiding part being connected with the air inlet part;

a second air-guiding part connected with the other end portion of the first air-guiding part and being the flexible hose, and for providing a second portion of the passageway to guide the air from the first air-guiding part, one end portion of the second air-guiding part being connected with the other end portion of the first air-guiding part; and a third air-guiding part connected with the other end portion of the second air-guiding part, and for providing a third portion of the passageway to guide the air from the second air-guiding part, one end portion of the third air-guiding part being connected with the other end portion of the second air-guiding part, the other end portion of the third air-guiding part being connected with the circular hole of the door part to communicate the air-guiding part with the dust bag receptacle part.

3. The dust-collecting unit for a combination-type vacuum cleaner as claimed in claim 1, wherein the dust bag receptacle part includes:

a rib part having a plurality of ribs longitudinally protruded from a bottom of the dust bag receptacle part, and for preventing the dust bag from being in close contact with the bottom thereof when the dust bag is inflated by air flowing in from the air-guiding part; and a pair of dust bag fixing parts upwardly and opposedly protruded from opposite sides of the dust bag receptacle part, and for fixing the dust bag to thereby prevent the dust bag from moving about.

4. The dust-collecting unit for a combination-type vacuum cleaner as claimed in claim 1, wherein the door body part has a rectangular recessed portion to accommodate the portion of the air-guiding part, and is hingedly connected with the main body to be rotated to close and open the dust bag receptacle part, the rectangular recessed portion has the circular hole in a bottom face of the rectangular recessed portion; and a first cover having a knob to facilitate the opening and closing of the door part, and engaged with the door body part to cover the door body part while firmly accommodating the third air-guiding part.

5. The dust-collecting unit for a combination-type vacuum cleaner as claimed in claim 1, wherein the main body further comprises:

a connecting portion having a plurality of engagement grooves thereon to firmly fix the first cover to the main body;

a pair of first protrusions protruded from the main body below the dust bag receptacle part and each having an insertion hole to be hingedly engaged with the door body part, so that the door part rotatably opens and closes the dust bag receptacle part; and a sealing member mounted on an upper wall of the dust bag receptacle part, and for preventing the air from flowing out of the dust bag receptacle part.

6. A dust collecting unit for a combination-type vacuum cleaner having a dust-collecting body and a cleaner body unit, and alternatively operable as an upright-type vacuum cleaner or as a canister-type vacuum cleaner by engaging or disengaging the dust-collecting body with or from the cleaner body unit providing an air suction force, comprising:

a cleaner brush head having a suction slit for suctioning air together with dust from outside;

a dust-collecting body for receiving the air suctioned from the suction slit, filtering the received air to collect dust therein, and exhausting the filtered air, which is dust-free air, the dust-collecting body having:

a main body having an air outlet part in order for the filtered air to be exhausted to the cleaner body unit;

an air inlet part communicated with the suction slit of the cleaner brush head, and for receiving the suctioned air;

an air-guiding part communicated with the air inlet part, and for providing a passageway to guide the received air, wherein a portion of the air-guiding part is a flexible hose to provide flexibility to the air-guiding part, the air-guiding part including:

(1) a first air-guiding part connected with the air inlet part, and for providing a first portion of the passageway to guide the dust-collecting air suctioned from the air inlet part, one end portion of the first air-guiding part being connected with the air inlet part;

(2) a second air-guiding part connected with the other end portion of the first air-guiding part and being the flexible hose, and for providing a second portion of the passageway to guide the air from the first air-guiding part, one end portion of the second air-guiding part being connected with the other end portion of the first air-guiding part; and (3) a third air-guiding part connected with the other portion of the second air-guiding part, and for providing a third portion of the passageway to guide the air from the second air-guiding part, one end portion of the third air-guiding part being connected with the other end portion of the second air-guiding part, the other end portion of the third air-guiding part being connected with the circular hole of the door part to communicate the air-guiding part with the dust bag receptacle part;

a dust bag receptacle part formed in the main body, and for accommodating a dust bag, the air outlet part communicating with the dust bag receptacle part, the dust bag receptacle part including:

(1) a rib part having a plurality of ribs longitudinally protruded from a bottom of the dust bag receptacle part, and for preventing the dust bag from being in close contact with the bottom thereof when the dust bag is inflated by air flowing in from the air-guiding part; and (2) a pair of dust bag fixing parts upwardly and oppositely protruded from opposite sides of the dust bag receptacle part, and for fixing the dust bag to thereby prevent the dust bag from moving about;

a door part hingedly engaged with the main body, having a first cover and a door part with a circular hole, and accommodating a portion of the air-guiding part between the door body part and the first cover, and for rotatably closing and opening the dust bag receptacle part, thereby engaging or disengaging one end portion of the air-guiding part with or from the dust bag receptacle part, wherein the flexible hose is extended below the first cover to provide flexibility when the door part opens and closes, and the end of the portion of the air-guiding part is engaged with the circular hole for the suctioned air to flow in the dust bag receptacle part when the door part closes;

a second cover engaged with the main body and having an engagement/disengagement part for engaging or disengaging the dust collecting body with or from the cleaner body unit, and having a groove formed on an upper portion of the second cover for accommodating a portion of the flexible hose for flexibility when the door part opens and closes, the second cover covering the portion of the air-guiding part between the door part and the air inlet part; and a dust bag holding part mounted on the main body to be rotated inside and outside the dust bag receptacle part, the dust bag holding part accommodating the dust bag, wherein the dust bag holding part is rotated in and out as the door part closes and opens the dust bag receptacle part.

7. The dust-collecting unit for a combination-type vacuum cleaner as claimed in claim 6, wherein the door body part has a rectangular recess to accommodate the portion of the air-guiding parts and is hingedly connected with the main body to be rotated to close and open the dust bag receptacle part, the rectangular recess having the circular hole and the first cover has a knob to facilitate the opening and closing of the door part, and the first cover is engaged with the door body part to cover the door body part while firmly accommodating the third air-guiding part.

8. The dust-collecting unit for a combination-type vacuum cleaner as claimed in claim 6, wherein the main body further comprises:

a connecting portion having a plurality of engagement grooves firmly fix the first cover to the main body;

a pair of first protrusions protruded from the main body below the dust bag receptacle part and each having an insertion hole to be hingedly engaged with door body part, so that the door part rotatably opens and closes the dust bag receptacle part; and a sealing member mounted on an upper wall of the dust bag receptacle part, and for preventing the air from flowing out of the dust bag receptacle part.

* * * * *